US007314058B2

(12) United States Patent
Saito

(10) Patent No.: US 7,314,058 B2
(45) Date of Patent: Jan. 1, 2008

(54) RESERVOIR TANK FOR STORING A LIQUID

(75) Inventor: Masashi Saito, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 262 days.

(21) Appl. No.: 10/891,080

(22) Filed: Jul. 15, 2004

(65) Prior Publication Data

US 2005/0011899 A1 Jan. 20, 2005

(30) Foreign Application Priority Data

Jul. 18, 2003 (JP) ..... 2003-199167

(51) Int. Cl.
*B63B 39/03* (2006.01)
*G01M 3/00* (2006.01)

(52) U.S. Cl. ..... 137/312; 220/565; 220/653

(58) Field of Classification Search ..... 137/312; 220/565, 567.3, 651, 652, 653
See application file for complete search history.

(56) References Cited

U.S. PATENT DOCUMENTS 2,460,054 A * 1/1949 Wiggins ..... 137/312
3,902,356 A * 9/1975 Rupf-Bolz ..... 73/49.2
4,871,081 A * 10/1989 Ershig ..... 220/565
5,096,087 A * 3/1992 Thomas ..... 137/312
5,102,803 A * 4/1992 Weaver ..... 435/290.2

FOREIGN PATENT DOCUMENTS

DE 10234190 A1 * 2/2004
JP 9-272991 A 10/1997

* cited by examiner

*Primary Examiner*—Kevin Lee
(74) *Attorney, Agent, or Firm*—Birch, Stewart, Kolasch & Birch, LLP

(57) ABSTRACT

A reservoir tank comprises a tank body and a double bottom. The tank body is constituted of a roof, a tank bottom plate and a tank wall. The roof and the tank bottom plate are fixed to the tank wall by welding. The double bottom includes a double bottom plate and a rim, which are fixed to each other by welding. A leakage liquid outlet is formed at one side of the double bottom plate on which reinforcement ribs are arranged in a lattice state. Cutouts are formed in the reinforcement ribs. The double bottom plate has a declivity so that the leakage liquid outlet is positioned at the lowermost level. The rim is provided with three detection ports. Upon welding the tank wall to the rim, the inside of the double bottom becomes an airtight state.

11 Claims, 4 Drawing Sheets

RESERVOIR TANK FOR STORING A LIQUID

This Non-provisional application claims priority under 35 U.S.C. § 119(a) on Patent Application No(s). 2003-199167 filed in Japan on Jul. 18, 2003, the entire contents of which are hereby incorporated by reference.

BACKGROUND OF THE INVENTION

1. Field of the Invention

The present invention relates to a reservoir tank for storing a liquid, and in particular to a reservoir tank whose bottom structure is improved.

2. Description of the Related Art

There is a reservoir tank for storing a liquid. It is necessary to seal the inside of the reservoir tank in order to prevent the stored liquid from leaking. If the bottom of the reservoir tank corrodes due to deterioration and so forth, the liquid is likely to leak therefrom. For the purpose of preventing the stored liquid from leaking out of the reservoir tank, various ideas are conceived regarding a bottom structure of the reservoir tank, such as described in Japanese Patent Laid-Open Publication No. 9-272991, for example. The Publication No. 9-272991 relates to an electric anticorrosion method for an outer surface of a tank bottom plate to be placed on an asphalt sand. With respect to this method, linear insoluble electrodes are arranged on the asphalt sand in a lattice state. A conductive material is laid over the whole surface of the asphalt sand so as to cover the insoluble electrodes. Further, a sand layer is formed on the conductive material. The insoluble electrode is connected to a plus side of a DC power supply and the tank is connected to a minas side thereof to supply a predetermined anticorrosive current to the outer surface of the tank bottom plate.

However, as for the electric anticorrosion method of the above-noted publication wherein an external power-supply system is adopted for the outer surface of the bottom plate of the outdoor tank, it is necessary to lay the linear insoluble electrodes on the asphalt sand, on which the reservoir tank is placed, in the lattice state. Thus, there arise problems in that an installation operation takes a lot of labor and the cost increases. In a case of the outdoor-type reservoir tank having a large size, it is impossible to transfer it through a general rode. Therefore, welding for assembly is performed at a place for setting the reservoir tank. Sometimes it is impossible to deal with the reservoir tank such as described in the above-noted Publication No. 9-272991. Further, it is difficult to externally check the liquid leaking out of the bottom. In case the liquid leaks out of the bottom, there arises a problem in that the leakage liquid pollutes the underground.

SUMMARY OF THE INVENTION

In view of the foregoing, it is a primary object of the present invention to provide a reservoir tank adapted to prevent underground pollution to be caused by a liquid, which has leaked out of the bottom thereof.

It is a second object of the present invention to provide a reservoir tank adapted to securely retrieve a leakage liquid.

In order to achieve the above and other objects, the reservoir tank according to the present invention comprises a tank body and a double bottom. The tank body stores a liquid. The double bottom is fixed to the bottom of the tank body. It is preferable that the double bottom has an airtight structure and a declivity. Further, it is preferable that the double bottom is provided with a port for detecting gas concentration.

In a preferred embodiment, the double bottom comprises a reinforcement member for supporting a tank bottom plate of the tank body. The reinforcement member is formed with a cutout through which the leakage liquid is allowed to move. Moreover, it is preferable that the double bottom has an outlet for discharging the leakage liquid accumulated in the double bottom. The tank is preferable to be a large-sized outdoor tank of which the tank body is directly fixed to a base.

According to the reservoir tank of the present invention, the liquid having leaked from the tank body is accumulated in the double bottom so that the liquid is prevented from flowing out of the reservoir tank. Since the double bottom has the airtight structure, the leakage liquid is surely prevented from flowing out of the reservoir tank all the more.

The double bottom has the declivity so that the leakage liquid is easily discharged to the outside. Since the double bottom is provided with the port for detecting gas concentration, it is possible to confirm whether or not the liquid leaks from the tank body to the double bottom. Moreover, since the double bottom has the outlet for discharging the leakage liquid of the double bottom, the leakage liquid, which is accumulated in the double bottom, is easily discharged to the outside.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
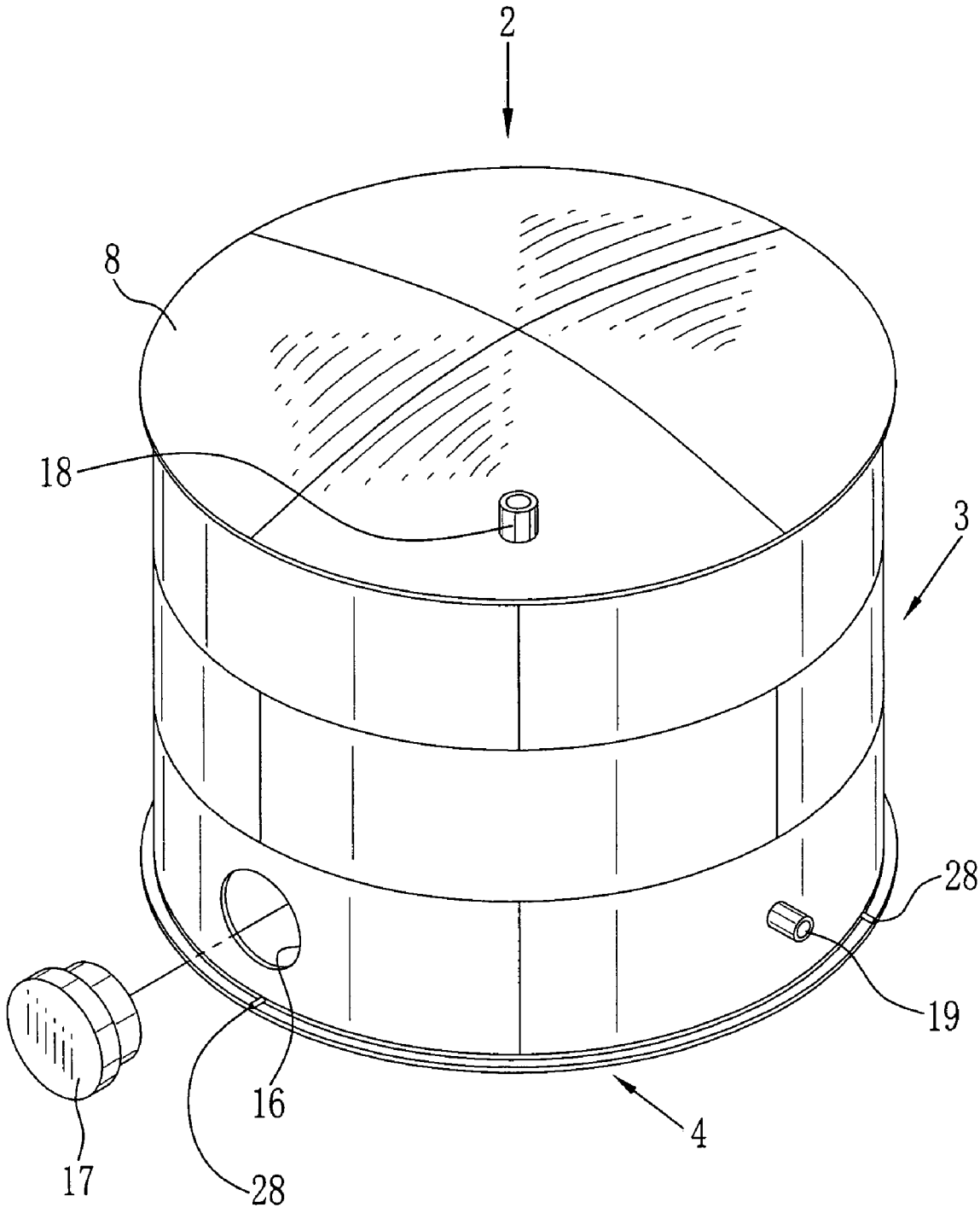
FIG. 1 is a perspective view showing a reservoir tank according to the present invention.

As shown in FIG. 1, a reservoir tank 2 according to the present invention comprises a tank body 3 and a double bottom 4 attached to the bottom of the tank body 3. The reservoir tank 2 is of an outdoor type. The tank body 3 has a cylindrical shape and stores a liquid 6 of various solvents, heavy oil, oil and so forth. As to the solvents, there are methylene chloride, methyl acetate, acetone, methyl formate, dioxoran, cyclopentane and so forth. The reservoir tank 2 has a capacity of 50 KL or more, and preferably 100 KL or more. The reservoir tank 2 is assembled at an installation place. However, the present invention is applicable to the other reservoir tank to be assembled in a small factory.

Figure 2:
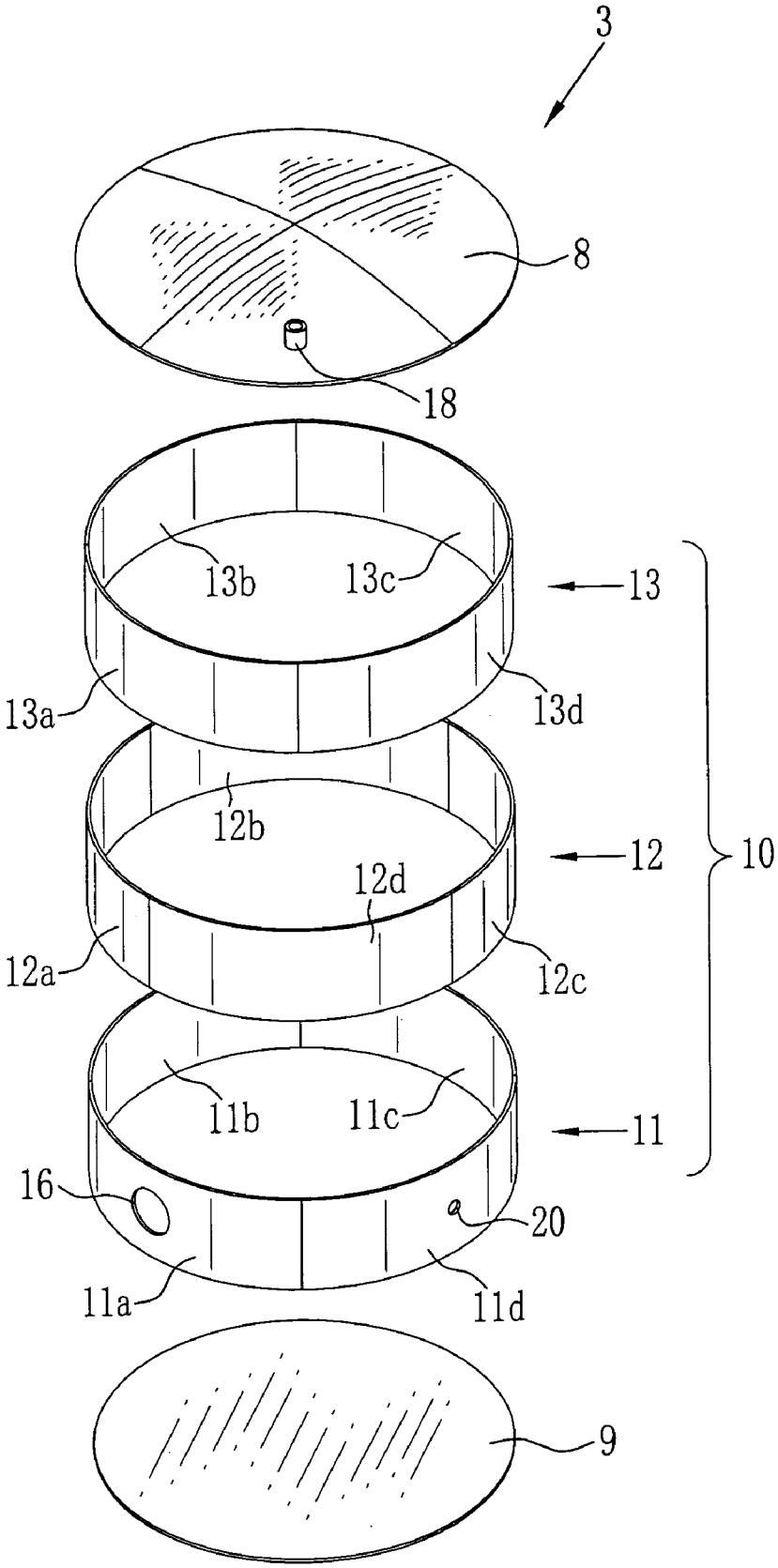
FIG. 2 is an exploded perspective view showing a tank body.

As shown in FIG. 2, the tank body 3 is constituted of a roof 8, a tank bottom plate 9 and a tank wall 10. This tank wall 10 has a three-part structure and is constituted of a first wall 11, a second wall 12 and a third wall 13. The first wall 11 is the lowermost part, and the third wall 13 is the uppermost part. The second wall 12 is the intermediate part and is fixed to the first and third walls 11 and 13 by means of welding. The first wall 11 is constituted of four wall segments 11*a* to 11*d*. The second wall 12 is constituted of four wall segments 12*a* to 12*d*. The third wall 13 is constituted of four wall segments 13*a* to 13*d*. Vertical welding lines of the respective wall segments 11*a* to 13*d* are alternately arranged so as to prevent the adjacent welding lines from continuing in a vertical direction. The roof 8 is fixed to an upper side of the wall segments 13*a* to 13*d* by means of welding. The tank bottom plate 9 is fixed to a lower side of the wall segments 11*a* to 11*d*.

The roof 8 has a taper shape going down toward the edge thereof. The wall segment 11*a* of the tank body 3 is formed with a maintenance opening 16 to which a flange 17 is fitted so as to cover it. When the inside of the tank body 3 is checked and cleaned, the flange 17 is detached. Incidentally, the roof 8 may be vertically moved, instead of attaching to the tank wall 10, depending on an amount of the liquid 6 stored in the tank body 3.

An inlet pipe 18 is attached to the roof 8. The inlet pipe 18 is inserted into the tank body 3. The liquid 6 is injected into the tank body 3 through the inlet pipe 18. An outlet pipe 19 is attached to the wall segment 11*d*. The outlet pipe 19 is welded to a through hole 20 (see FIG. 2) formed in the wall segment 11*d*. The outlet pipe 19 is connected to various manufacture lines via flanges, which are not shown, to transport the liquid 6. By the way, each of the inlet pipe 18 and the outlet pipe 19 is provided with a valve which is not shown. By opening the valve, it becomes possible to inject and transport the liquid 6. Meanwhile, although an illustration is omitted, various attachments of a thermometer, a pressure gauge and so forth are fixed to the tank body 3 and are covered with a heat-retention member, a protective cover and so forth as need arises.

Figure 3:
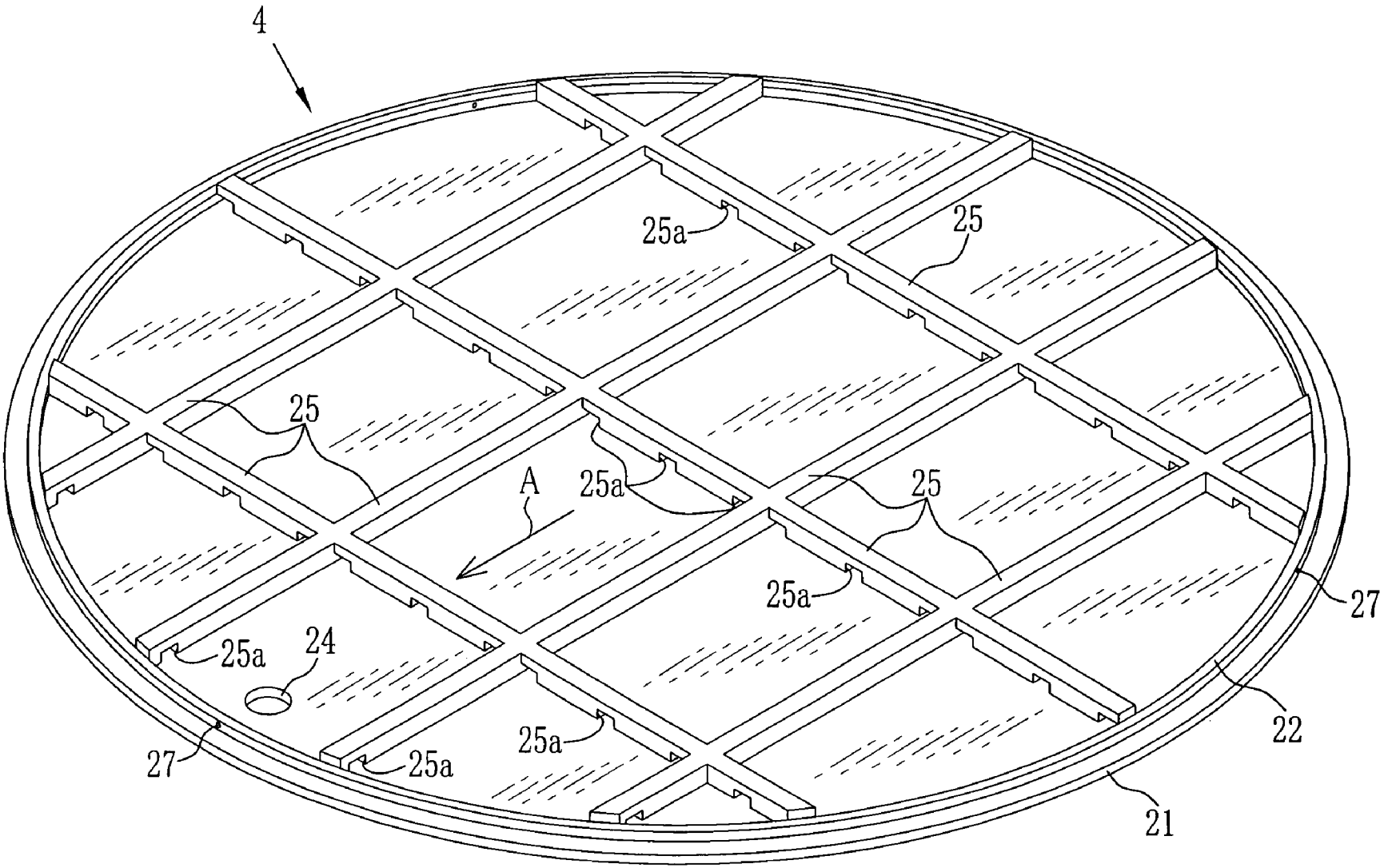
FIG. 3 is a perspective view showing a portion of a double bottom.

As shown in FIGS. 3 and 4, the double bottom 4 comprises a double bottom plate 21 and a rim 22 being as a side wall, which are fixed to each other by means of welding. A left side of the double bottom plate 21 is provided with a leakage liquid outlet 24 for discharging the accumulated liquid 6 to the outside. The leakage liquid outlet 24 is connected to a discharge pipe 31 described later. The double bottom plate 21 is provided with a plurality of reinforcement ribs 25 arranged in a lattice form. The reinforcement ribs 25 are provided with cutouts 25*a* for leading the liquid 6, which is accumulated in a region surrounded by the reinforcement ribs 25, to the leakage liquid outlet 24. A number and a shape of the cutouts 25*a* may be properly changed. Incidentally, a number of the reinforcement ribs 25 may be properly changed on condition that the double bottom plate 21 is reinforced.

The rim 22 is formed with three detection ports 27 for detecting the liquid 6 leaking from the tank body 3. The detection ports 27 are positioned at intervals of 120 degrees, for example. A checking pipe 28 (see FIG. 1) is welded to the detection port 27. A cap 29 is fitted to the checking pipe 28 and is detached at the time of inspection to insert a gas concentration meter and so forth. In this way, it is possible to confirm whether or not the liquid 6 leaks from the tank body 3 to the double bottom 4. It is needless to say that the number of the detection ports 27 may be properly changed.

Figure 4A:
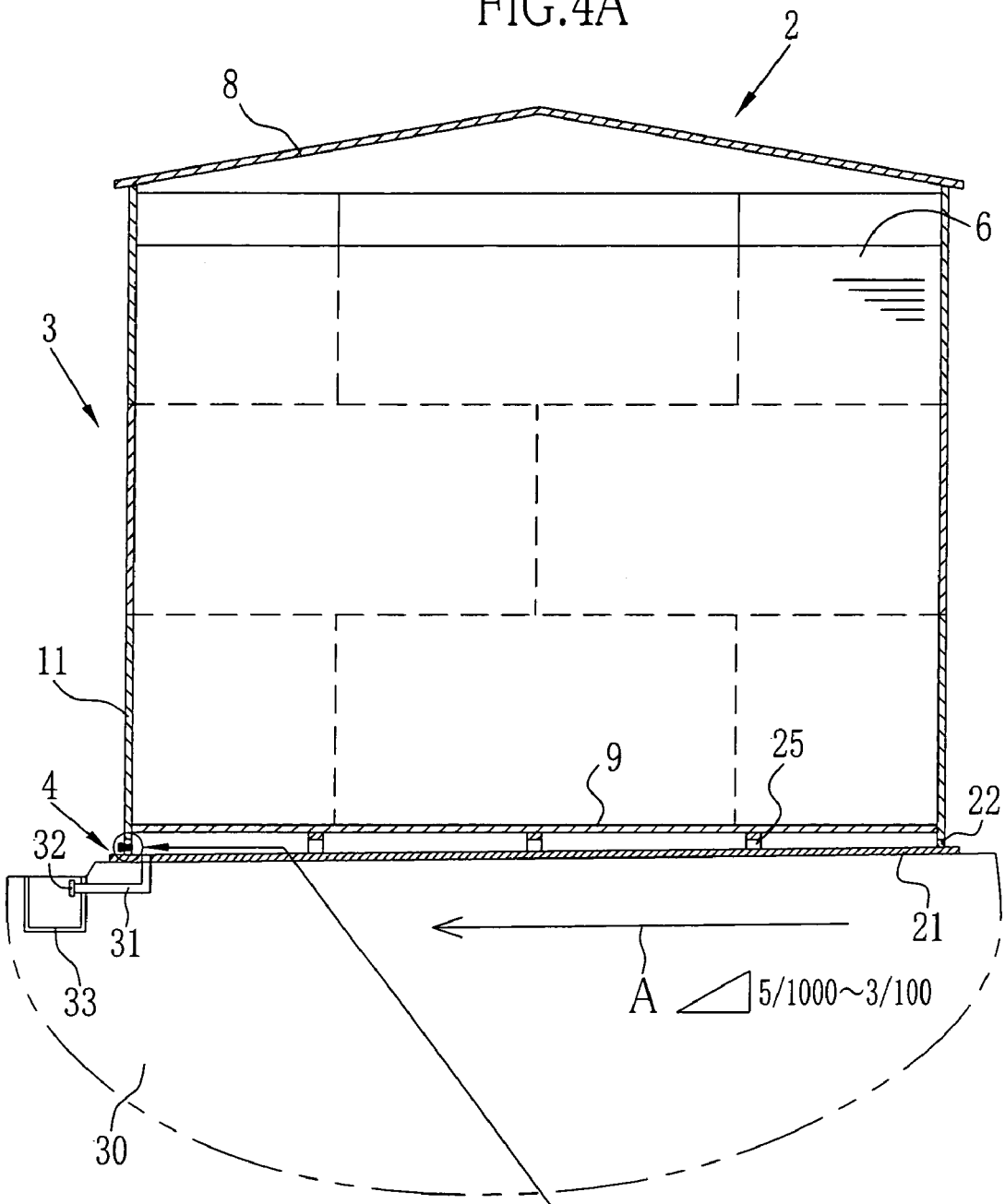
FIGS. 4A and 4B are section views showing the reservoir tank.
Figure 4B:
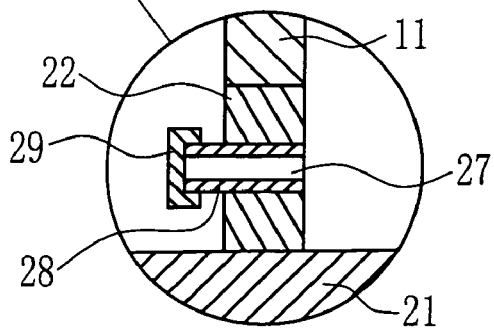

As shown in FIGS. 4A and 4B, the double bottom plate 21 is adapted to have a declivity in a slope direction A so that the leakage liquid outlet 24 is positioned at the lowermost level. In this embodiment, a ratio of the declivity is 1/100 and is preferable to be 5/1000 to 3/100. In virtue of the declivity, the liquid 6 having leaked from the tank body 3 to the double bottom 4 is concentrated at a left side (side of the leakage liquid outlet 24) of the double bottom 4.

The double bottom 4 is fixed to a concrete base 30 made in the outdoors. The concrete base 30 has a cutout through which the discharge pipe 31 passes to connect with a recovery pit 33. An exit of the discharge pipe 31 is provided with a valve 32. By opening this valve 32, the liquid 6 accumulated in the double bottom 4 flows into the recovery pit 33 to retrieve the liquid 6. By the way, instead of the discharge pipe 31, a recovery port may be formed in the rim 22. The recovery port is usually closed with a flange or the like, and is opened by detaching the flange to retrieve the liquid 6.

After assembling the double bottom 4 on the concrete base 30, the tank body 3 is built on the double bottom 4 such as described above. The first wall 11 of the tank body 3 is fixed to the rim 22 of the double bottom 4 by means of welding. Thereupon, the inside of the double bottom 4 becomes an airtight state.

As just described, the double bottom 4 is fixed to the bottom portion of the tank body 3 and the inside of the double bottom 4 is sealed. Thus, in case the liquid 6 leaks from the tank body 3, the leakage liquid is accumulated in the double bottom 4 and is prevented from leaking to the outside of the reservoir tank 2. Further, by inserting the gas concentration meter and so forth into the detection port 27 formed in the double bottom 4, it is possible to confirm whether or not the liquid 6 leaks from the tank body 3 to the double bottom 4. Since the leakage liquid outlet 24 is formed in the left side of the double bottom plate 21 and is connected to the discharge pipe 31, the liquid 6 accumulated in the double bottom 4 is gathered into the recovery pit 33 through the discharge pipe 31.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A reservoir tank comprising:

a tank body for storing a liquid, wherein said tank body comprises a roof, a tank bottom plate and a tank wall, said tank wall being constituted of plural wall members, and wherein said plural wall members are welded to each other, and welding lines of said plural wall members are alternately arranged in a vertical direction; and a double bottom disposed at the bottom of said tank body; wherein (1) said double bottom comprises:

(a) a detection port for detecting gas concentration, (b) a double bottom plate disposed so as to keep a gap relative to a tank bottom plate of said tank body, (c) a side wall cylindrically protruding upward from a periphery of said double bottom plate, said side wall surrounding said tank bottom plate and being fixed to said tank body, and a sealed space being formed by said tank bottom plate, said double bottom plate and said side wall; and (2) said detection port is formed in said side wall of said double bottom plate.

2. A reservoir tank according to claim 1, wherein said double bottom has an airtight structure.

3. A reservoir tank according to claim 1, wherein said double bottom has a declivity.

4. A reservoir tank according to claim 1, wherein said double bottom further comprises:

a reinforcement member disposed on said double bottom plate to support said tank bottom plate; and a cutout formed in said reinforcement member, said cutout allowing a leakage liquid to move, said leakage liquid leaking from said tank bottom plate and accumulating in said space.

5. A reservoir tank according to claim 4, wherein said reinforcement member is disposed in a lattice form.

6. A reservoir tank according to claim 5, wherein said cutout is formed at a lower side of said reinforcement member.

7. A reservoir tank according to claim 1, wherein said double bottom comprises:

a leakage liquid outlet formed in said double bottom plate to discharge said leakage liquid.

8. A reservoir tank according to claim 7, further comprising:

a discharge pipe attached to said leakage liquid outlet; and a recovery pit connected to said discharge pipe, said leakage liquid flowing into said recovery pit through said discharge pipe.

9. A reservoir tank according to claim 8, further comprising:

a valve disposed at an exit of said discharge pipe, said leakage liquid flowing into said recovery pit by opening said valve.

10. A reservoir tank according to claim 1, wherein said tank is a large-sized tank of an outdoor installation type, said double bottom being assembled on a base made at the outdoor, and said tank body is welded to said double bottom.

11. A reservoir tank according to claim 1, wherein said tank body is formed with a maintenance opening through which the inside of said tank body is checked and cleaned.

* * * * *